US011668183B2

(12) United States Patent
Downey et al.

(10) Patent No.: US 11,668,183 B2
(45) Date of Patent: Jun. 6, 2023

(54) FIBER DEPLOYMENT SYSTEM AND COMMUNICATION

(71) Applicant: Halliburton Energy Services, Inc., Houston, TX (US)

(72) Inventors: Luke Christopher Downey, Kingwood, TX (US); Christopher Lee Stokely, Houston, TX (US); John Laureto Maida, Jr., Houston, TX (US); John Paul Bir Singh, Kingwood, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/451,769

(22) Filed: Oct. 21, 2021

(65) Prior Publication Data

US 2022/0034215 A1 Feb. 3, 2022

Related U.S. Application Data

(63) Continuation of application No. 16/642,498, filed as application No. PCT/US2017/068284 on Dec. 22, 2017, now Pat. No. 11,187,072.

(51) Int. Cl.

| | |
|---|---|
| ***E21B 47/005*** | (2012.01) |
| ***E21B 33/14*** | (2006.01) |
| ***E21B 34/06*** | (2006.01) |
| ***E21B 23/14*** | (2006.01) |
| *E21B 47/135* | (2012.01) |

(Continued)

(52) U.S. Cl.

CPC ..... *E21B 47/005* (2020.05); *E21B 23/14* (2013.01); *E21B 33/14* (2013.01); *E21B 34/06* (2013.01); *E21B 33/13* (2013.01); *E21B 33/16* (2013.01); *E21B 47/135* (2020.05)

(58) Field of Classification Search

CPC ..... E21B 47/005; E21B 23/14; E21B 33/14; E21B 34/06; E21B 7/135; E21B 33/16; E21B 47/113; E21B 33/13; E21B 47/10; E21B 47/12

See application file for complete search history.

(56) References Cited

U.S. PATENT DOCUMENTS

| | | | |
|---|---|---|---|
| 5,578,820 | A | 11/1996 | Gadeken et al. |
| 6,847,034 | B2 | 1/2005 | Shah et al. |

(Continued)

FOREIGN PATENT DOCUMENTS

| | | |
|---|---|---|
| GB | 2522211 | 7/2015 |
| GB | 2580804 | 4/2022 |

OTHER PUBLICATIONS

"GB Application No. 2004026.7 Search Report", dated Mar. 16, 2022, 5 pages.

(Continued)

*Primary Examiner* — Brad Harcourt

(74) *Attorney, Agent, or Firm* — Delizio, Peacock, Lewin & Guerra

(57) ABSTRACT

A flow assembly is deployed downhole in a casing for a cementing operation. The flow assembly has a spool with an optical cable. As cement is pumped downhole and through the flow assembly, a dart attached to the optical cable on the spool is dragged with the flow of cement. Cement flow is stopped based on signals along the optical cable that the dart is at a desired location downhole.

19 Claims, 10 Drawing Sheets

(51) Int. Cl.
*E21B 33/16* (2006.01)
*E21B 33/13* (2006.01)

(56) References Cited

U.S. PATENT DOCUMENTS

| | | | | |
|---|---|---|---|---|
| 2004/0045705 | A1 | 3/2004 | Gardner et al. | |
| 2004/0047534 | A1 | 3/2004 | Shah et al. | |
| 2004/0060697 | A1* | 4/2004 | Tilton | E21B 47/01 166/250.14 |
| 2008/0272931 | A1 | 11/2008 | Auzerais et al. | |
| 2009/0219171 | A1 | 9/2009 | Vigneaux | |
| 2011/0094741 | A1 | 4/2011 | Vigneaux et al. | |
| 2011/0162844 | A1 | 7/2011 | Mauth et al. | |
| 2012/0000650 | A1 | 1/2012 | James et al. | |
| 2012/0000655 | A1* | 1/2012 | James | E21B 47/06 166/70 |
| 2012/0205103 | A1 | 8/2012 | Ravi et al. | |
| 2014/0034301 | A1 | 2/2014 | Leblanc | |
| 2014/0338438 | A1* | 11/2014 | Fripp | G01H 9/004 73/152.16 |
| 2018/0252100 | A1* | 9/2018 | Ranjan | E21B 17/1078 |
| 2019/0153849 | A1* | 5/2019 | Kent | E21B 47/18 |
| 2020/0041686 | A1* | 2/2020 | Barfoot | E21B 33/14 |

OTHER PUBLICATIONS

PCT Application Serial No. PCT/US2017/068284, International Search Report, dated Sep. 20, 2018, 3 pages.
PCT Application Serial No. PCT/US2017/068284, International Written Opinion, dated Sep. 20, 2018, 8 pages.
GCC Application Serial No. GC 2018-36495; First Office Action; dated Jan. 27, 2020, 4 pages.

* cited by examiner

FIBER DEPLOYMENT SYSTEM AND COMMUNICATION

TECHNICAL FIELD

This disclosure generally relates to formation of a well. It relates particularly to sensing the conditions in a casing inserted into a wellbore and in an annulus between the casing and a wall of the wellbore, for example, during a cementing process.

BACKGROUND ART

A wellbore is a drilled hole in a geological formation. The drilled hole extends beneath a surface of the Earth to hydrocarbon resources such as oil and natural gas in the geological formation. After drilling, the wellbore can be lined with a casing defined by a large-diameter pipe lowered into the wellbore. An annulus is then formed between an outer portion of the casing and wall of the wellbore.

The annulus is typically sealed by filling it with cement. For example, cement is pumped downhole through the casing in a forward cementing process. The cement flows up into the annulus via a shoe of the casing. Alternatively, the cement is pumped downhole directly into the annulus in a reverse cementing process. Upon hardening, the cement seals the space in the annulus.

BRIEF DESCRIPTION OF THE DRAWINGS

Embodiments of the disclosure may be better understood by referencing the accompanying drawings.

DESCRIPTION OF EMBODIMENTS

Figure 1:
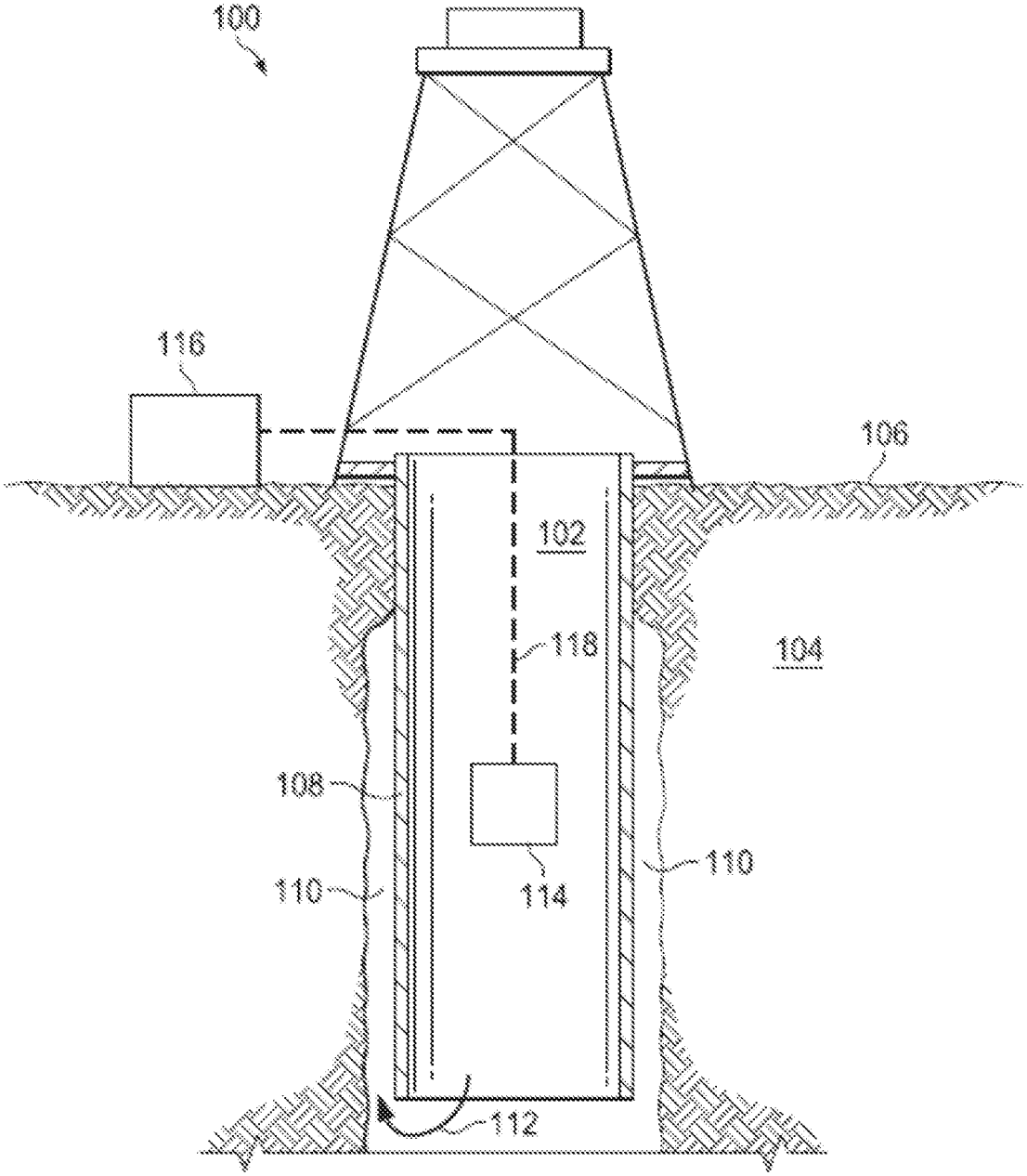
FIG. 1 is a diagram of an example well system.

Embodiments described herein are directed to a method, system, and apparatus for sensing one or more parameters in a casing inserted into a wellbore and annulus between the casing and a wall of the wellbore, for example, during a cementing process.

In one embodiment, a float collar may be connected to a casing inserted into a wellbore. The float collar may have a body with a top surface and bottom surface. The float collar may be oriented so that the top surface faces toward an opening of the wellbore and the bottom surface is opposite to the top surface on the body and faces further downhole. A bobbin may be affixed to the bottom surface. The bobbin may be a spool of optical cable. Further, the float collar may have one or more ports on the top surface which receives fluid in the wellbore and one or more ports on the bottom surface of the float collar which outputs the fluid. The one or more ports may also have one or more check valves to allow fluid in the wellbore to flow from the top surface of the float collar to below the bottom surface of the float collar and to prevent the fluid from reversing flow back from the bottom surface to the top surface.

Fluid such as cement may be pumped downhole through the wellbore and the check valve may be arranged to allow the fluid to flow from the top surface of the float collar to the bottom surface of the float collar. The fluid may flow in a manner such that the fluid first flows into the annulus, filling it, and then filling the casing downhole of the float collar.

The optical cable may be released from the bobbin in response to a plug landing on top of the float collar. The fluid which flows from the top surface of the float collar to the bottom surface of the float collar and further downhole causes the optical cable to also be dragged further downhole. In some cases, this optical cable may float down to a shoe of the casing and up into the annulus. The optical cable may facilitate sensing one or more conditions in the casing and/or annulus such as electrical conductivity, temperature, pressure, dielectric response, and specific ion concentration. Signals associated with the sensing may be conveyed from the optical cable to a data processing system via telemetry associated with the plug. The data processing system may monitor the signals associated with optical cable and disable pumping of the cement when the cement reaches a certain level in the annulus and/or casing. This may indicate that the annulus is filled with cement.

In other embodiments, a cross-over tool may be connected to the casing inserted into a wellbore. The cross-over tool may have a body with a top surface and bottom surface. The cross-over tool may be located at an opening of the casing and oriented such that the top surface faces the opening of the wellbore and the bottom surface is opposite to the top surface on the body and faces further downhole. The cross-over tool may have one or more ports on the top surface of the cross-over tool which receives fluid in the wellbore and one or more ports on the bottom surface of the cross-over tool which outputs fluid into the annulus or casing. The cross-over tool may also have a bobbin affixed to the bottom surface of the cross-over tool with an optical cable. An end of the optical cable associated with the cross-over tool may have a drag member.

The one or more port of the cross-over tool may be arranged to initially allow fluid from the wellbore to enter a port from the top surface of the cross-over tool and exit a port on the bottom surface of the float collar into the casing further downhole. The optical cable and drag member may be released from the bobbin of the cross-over tool. The fluid may drag the drag member downhole and mate with a float assembly downhole. The float assembly and/or drag member may be equipped with various sensors (pH sensors, electrical conductivity sensors, temperature sensors, pressure sensors, dielectric response sensors, and specific ion concentration sensors are a few of the possibilities) for measuring a condition of the fluid at the location of the float assembly.

Then, the one or more ports of the cross-over tool may be arranged to allow fluid in the wellbore to flow into the annulus. The fluid may take the form of cement. Signals from the sensors may be conveyed from the float assembly to the cross-over tool via the optical cable. In some cases, the signals may be further conveyed to a data processing system also via an optical cable. The data processing system may monitor the signals and control the cementing process. For example, pumping of the cement may be disabled when the cement pumped through the annulus reaches the float assembly after filling the annulus and space in the casing below the cross-over tool. This may indicate that the annulus is filled with cement.

The description that follows includes example systems, apparatuses, and methods that embody aspects of the disclosure. However, it is understood that this disclosure may be practiced without these specific details. For instance, this disclosure refers to sensing one or more parameters in a casing inserted into a wellbore and in an annulus between the casing and a wall of the wellbore, for example, during a cementing process. Aspects of this disclosure can be also applied to any other applications requiring determination of conditions associated with subsurface formations. In other instances, well-known instructions, structures and techniques have not been shown in detail in order not to obfuscate the description.

Example Illustrations

FIG. 1 is a diagram illustrating an example of a well system 100. As shown, the well system 100 includes a wellbore 102 in a subsurface formation 104 beneath a surface 106 of a wellsite. Wellbore 102 as shown in the example of FIG. 1 includes a vertical wellbore. However, it should be appreciated that embodiments are not limited thereto and that well system 100 may include any combination of horizontal, vertical, slant, curved, and/or other wellbore orientations. The subsurface formation 104 may include a reservoir that contains hydrocarbon resources, such as oil or natural gas. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured initially to any significant degree.

In some examples, the wellbore 102 may be lined with a casing 108. The casing 108 may take the form of one or more pipes or other tubular structures inserted into the wellbore 102 to form a casing string which protects freshwater formations and/or isolates formations with significantly different pressure gradients. A space 110 between the casing 108 and wall of the wellbore 102 may be referred to as an annulus. Further, a bottom of the casing, e.g., shoe 112, may provide fluid communication with the annulus. During well formation, the annulus may be typically filled with cement to prevent fluid migration from the casing 108 into the annulus.

The well system may have one or more downhole sensors 114 to measure various conditions downhole such as pH, electrical conductivity, temperature, pressure, dielectric response, and specific ion concentration. One or more of the downhole sensors 114 may be communicatively coupled to a data processing unit 116. The data processing unit 116 may be located at the surface 106 (as shown) or downhole. Telemetry 118 is provided to transfer signals from the downhole sensors 114 to the surface 106. Any suitable telemetry, whether wired or wireless, can be used. Non-limiting examples include electromagnetic telemetry, electric line, acoustic telemetry, and pressure pulse telemetry, not all of which may be suitable for a given application.

Figure 2:
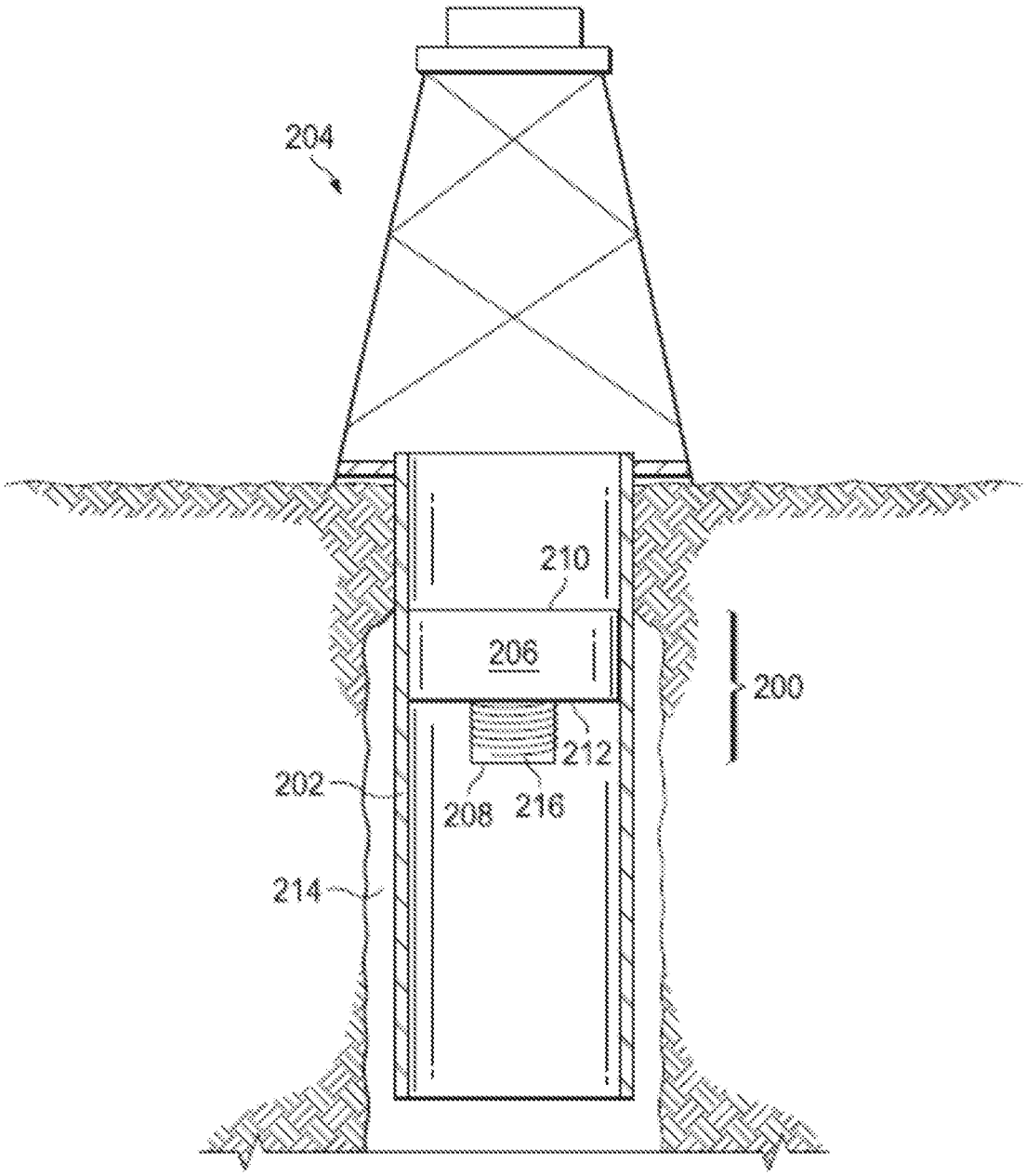
FIG. 2 is a diagram of a flow assembly in the example well system.

FIG. 2 is a diagram of a generalized flow assembly 200 for performing the sensing. The generalized flow assembly 200 may be arranged with respect to the casing 202 of a well system 204 and include a body 206 and bobbin 208 and located near a shoe of the well system 204. The body 206 may have a top surface 210 and a bottom surface 212 formed by a rigid material such as a steel, polymer, and/or cement. The top surface 210 may face an opening of the wellbore and the bottom surface 212 may be opposite to the top surface 210 of the body 206 and face further downhole. The body 206 may have one or more valves and/or ports (not shown) to control fluid flow as between the casing 202 and/or annulus 214. The bobbin 208 may be affixed to the bottom surface 212 of the body 206. The bobbin 208 may comprise an optical cable 216 which carries optical signals. In some examples, the optical cable 216 may be spooled around the bobbin 208.

The optical cable 216 can include a single-mode or multiple-mode fiber. Such fiber can be silicon or polymer or other suitable material, and preferably has a tough corrosion and abrasion resistant coating and yet is inexpensive enough to be disposable. Such optical cable 216 can include, but need not have, some additional covering. One example is a thin metallic or other durable composition carrier conduit. Further, the fiber and the carrier conduit can be moveable relative to each other so that the carrier conduit can be at least partially withdrawn to expose the fiber. Such a carrier conduit includes both fully and partially encircling or enclosing configurations about the fiber.

Any other suitable optical cable configuration may be used, one non-limiting example of which includes multiple bobbins of optical cables wherein a length of optical cables in each bobbin is different. The optical cable 216 may be coiled on the bobbin 208 in a manner that does not exceed at least the mechanical critical radius for the optical cable 216 and can be unspooled or uncoiled. The use of the term "bobbin" or the like does not imply the use of a rotatable cylinder but rather at least a compact form of the optical cable 216 that readily releases.

Figure 3:
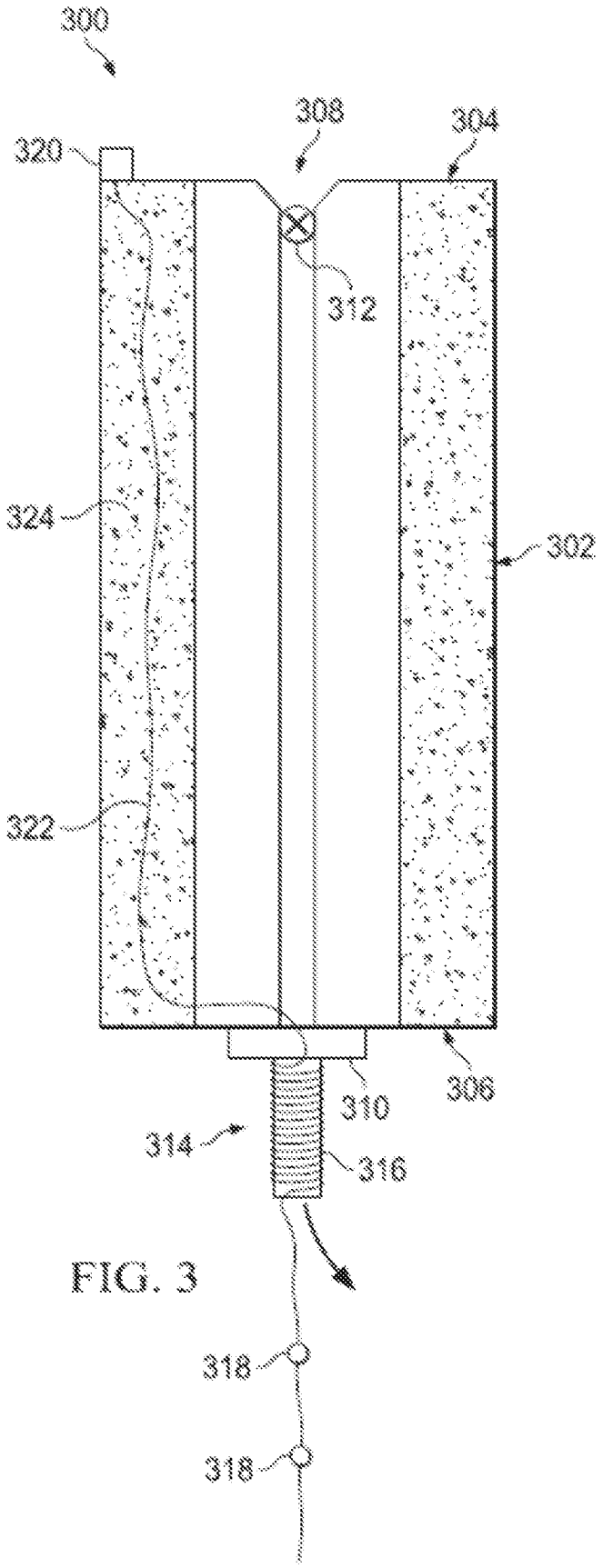
FIG. 3 is a diagram of the flow assembly in the form of a float collar in the example well system.

FIG. 3 is a diagram of the flow assembly which takes the form of a float collar 300 for performing the sensing. The float collar 300 may be connected to the casing inserted into a wellbore near the shoe. For example, the float collar may be threaded onto the casing. Other connections are also possible depending on a shape and size of the casing with respect the float collar 300.

A body 302 of the float collar 300 may have a top surface 304 and bottom surface 306. The top surface 304 and bottom surface 306 may be arranged in a manner similar to that of the generalized flow assembly described above. Further, the body 302 may have a port 308 on the top surface 304 and a port 310 the bottom surface 306, respectively. The port 308 may allow for fluid from the wellbore to enter the float collar 300 at the top surface 304, flow through the body 302 and exit the port 310 at the bottom surface of the body. Further, one or more of the ports 308, 310 may have a check valve 312, which allows flow of fluid in only one direction when fitted in the casing. For example, the check valve 312 may allow fluid to flow from the port 308 to the port 310 but not from the port 310 to the port 308. The body 302 may have other valves or ports as well.

A bobbin 314 of the float collar 300 may have an optical cable 316 with one or more sensors 318. Non-limiting examples of the one or more sensors 318 may include a pressure sensor, temperature sensor, a cable strain sensor, a micro-bending sensor, a chemical sensor, or a spectrographic sensor. For example, the optical cable 316 may have a chemical coating that swells in the presence of a chemical to be sensed, which swelling applies a pressure to the optical cable 316 to which the coating is applied and thereby affects the optical signal. As another example, the optical cable 316 may have fiber Bragg gratings which reflect light. The reflected light may be indicative of a sensed parameter, such as pressure and temperature, for example.

The body 302 of the float collar 300 may have a wet connect 320 and telemetry 322 to facilitate sending and/or receiving signals associated with the one or more sensors 318. The wet connect 320 may be a releasable connection of an electrical and/or optical contact including connecting male or female connecting assemblies. The telemetry 322 may take many forms. For example, the telemetry 322 may be another optical cable or electrical cable which connects to the optical cable 316. The other optical cable or electrical cable may be along the body 302 of the float collar 300 and encased in fill 324 such as cement. In the case that the wet connect is an electrical connection, the float collar 300 may have electronics for converting an optical signal to electrical signal and vice versa. As another example, the telemetry 322 may take the form of close-range proximity acoustics or radio frequency communication device. This telemetry 322 may facilitate transfer of the signals received at the optical cable 316 from the one or more sensors 318 to the wet connect 320 without need for expensive and unreliable optical or electrical connectors at the float collar 300.

Figure 4C:
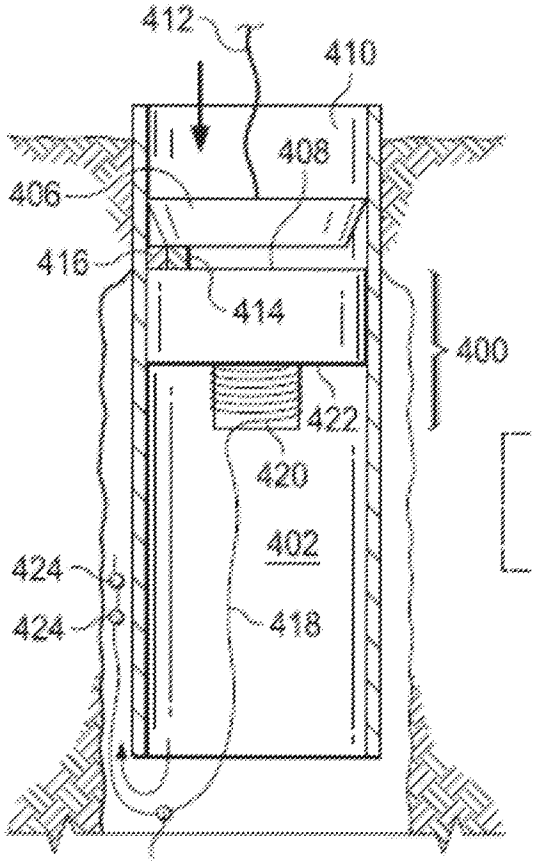
FIGS. 4A-C illustrates operation of the float collar in the example well system.
Figure 4B:
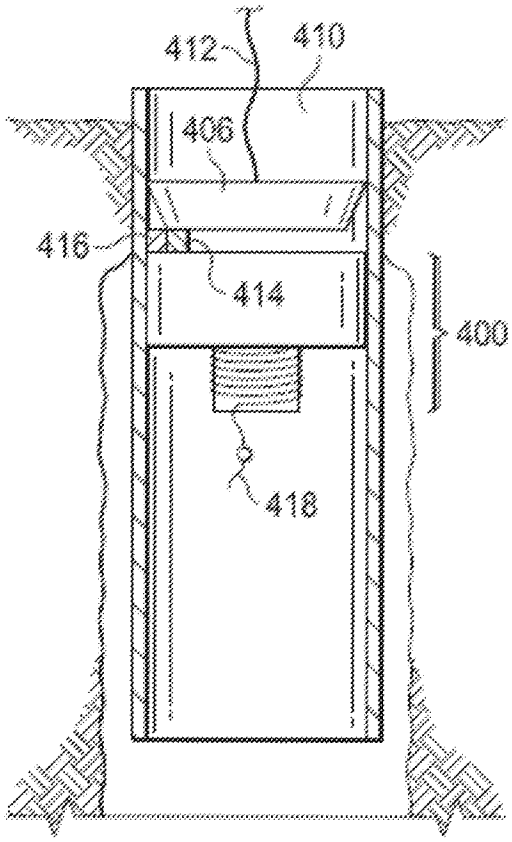
Figure 4A:
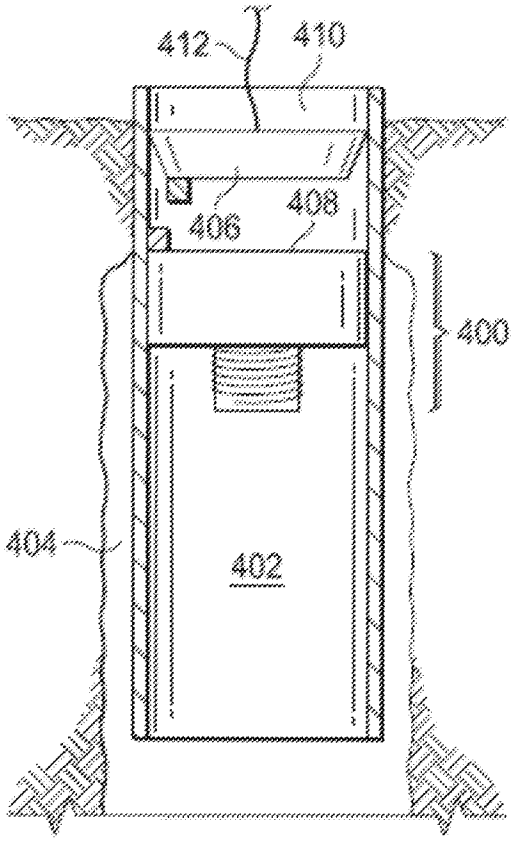

FIGS. 4A-4C illustrate an example process for using the float collar 400 to sense conditions in a casing 402 and/or annulus 404 of a well system. The figures are ordered in a time sequence such that operations associated with FIG. 4A occur before that of FIGS. 4B and 4C. Further, operations associated with FIG. 4B occur after operations associated with FIG. 4A and before operations associated with FIG. 4C. In other example operations, the order of the operations illustrated by FIGS. 4A-4C may be different.

In FIG. 4A, a plug 406 may approach a top surface 408 of the float collar 400 in the wellbore 410. The plug 406 may be used during cementing operations to help remove dispersed mud and mud sheath from the casing inner diameter and minimize the contamination of cement. The plug 406 may have telemetry 412 for facilitating communication with the data processing system.

In FIG. 4B, the plug 406 may contact the top surface 408 of the float collar 400 and sit on the float collar 400. When the plug 406 sits at the float collar 400, differential pressure may rupture a diaphragm (not shown) on the plug 406 allowing fluid to flow through. The plug 406 may have a corresponding connector 414 to a wet connect 416 of the float collar 400. In this regard, the seating of the plug 406 may result in the plug 406 being connected to the wet connect 416 and optical cable 418 of the float collar 400 to facilitate communication between the optical cable 418 and the data processing system via the connections 414, 416, and telemetry 412 between the plug 406 and the data processing system.

In FIG. 4C, the contact of the plug 406 on the float collar 400 may cause the bobbin 420 to release the optical cable 418. The bobbin 420 may be normally locked from rotating. When the plug 406 contacts the float collar 400, this lock is released and the bobbin 420 may freely spin. For example, the plug 406 may send a signal to the bobbin 420 via the connections 414, 416 to release the optical cable 418. As another example, the data processing system may receive an indication from the plug 406 that it has connected with the float collar 400 and the data processing system may send an indication to the float collar 400 to release the optical cable 418. As yet another example, the float collar 400 itself may release the lock upon the plug 406 contacting the float collar 400. The valve of the float collar may be arranged (e.g., opened) to allow fluid to flow through from the top surface 408 of the float collar 400 to the bottom surface 422 of the float collar 400 in the casing 402. Viscous drag of the fluid on the optical cable 418 may cause the bobbin 420 (which can freely spin) to unspool and transport a leading end of the optical cable 418 down the casing 402 and into the annulus 404. This leading end of the optical cable 418 with its sensors 426, is dispensed into the annulus 404 as the fluid flows up the annulus 404.

In some cases, the fluid may be cement for cementing the annulus 424. A light source may inject light into a fixed end of the optical cable 418. The fixed end may be opposite to the end which is pulled further downhole by the fluid flow. The light source may take the form of a broadband, continuous wave or pulsed laser or tunable laser located either at the surface or downhole. The sensors 426 of the optical cable 418 which is transported down the casing 402 and into the annulus 404 may be used to monitor and/or control the cementing process.

Figure 5:
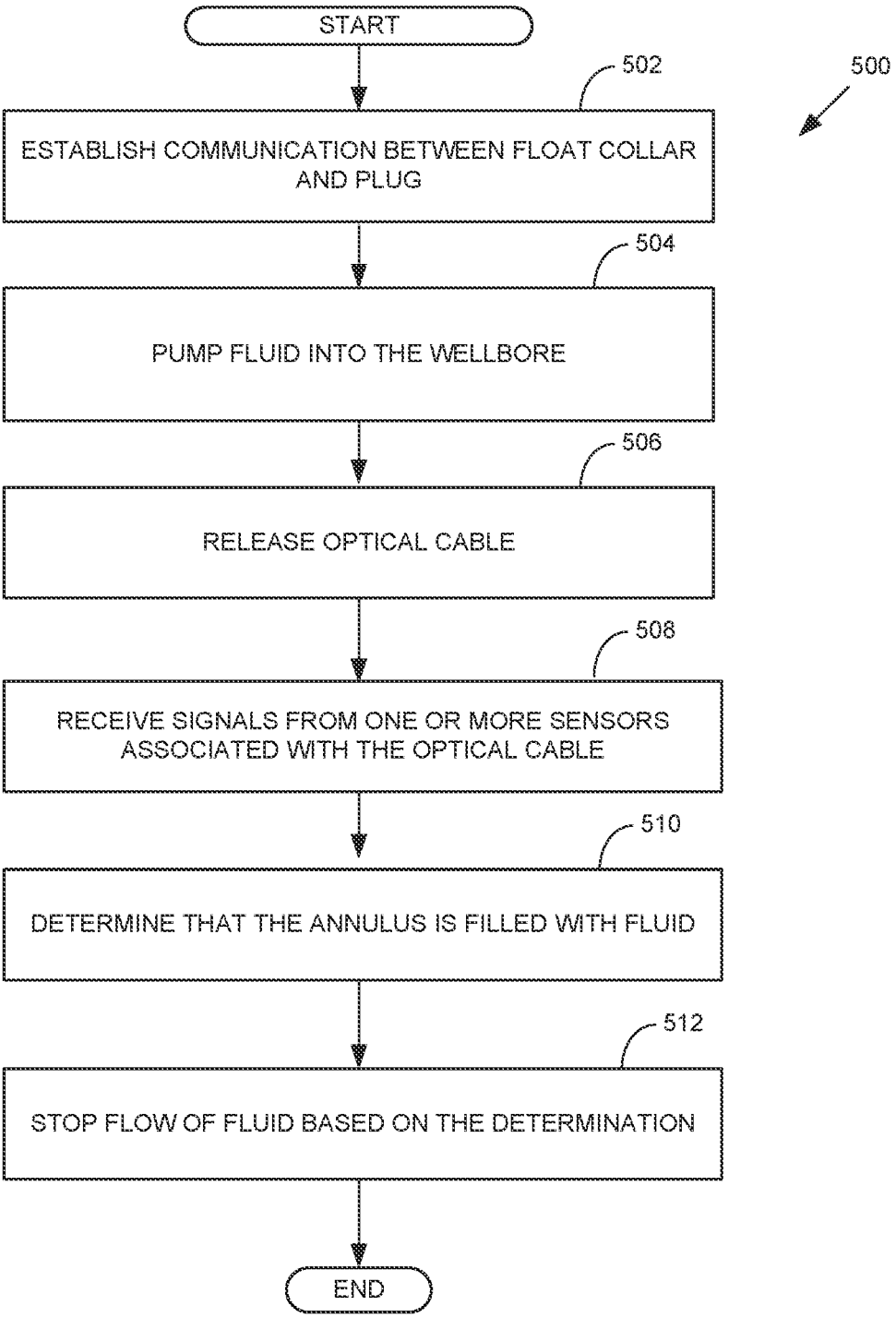
FIG. 5 is a flow chart of operations associated with a process using the flow collar.

FIG. 5 is a flow chart of operations associated with a process using the flow collar. The flow collar may be used to monitor pumping of cement into the annulus and/or casing on the bottom side of the float collar to seal the annulus.

At 502, communication between the float collar and plug may be established. For example, the plug may be released into the wellbore, reach the casing, and contact the float collar. The contact may be indicated by the communication between the float collar, plug, and/or data processing system via the wet connect. For instance, the float collar may send a signal indicative of the contact to the plug and/or the plug may send a signal indicative of the contact to the data processing system. In other examples, the communication may not require physical contact. For instance, communication may be established by proximity between the float collar and the plug and communication by radio frequency or acoustics. Other variations are also possible.

At 504, a fluid may be pumped into the wellbore. The fluid may flow through the ports and/or valves of the flow collar, further down the casing, and into the annulus to cement the annulus during well formation. The fluid may be one or more fluids. In some examples, the fluid may be or include a spacer such as to aid in removal of drilling fluid. The spacer is prepared with specific fluid characteristics, such as viscosity and density, that are engineered to displace drilling fluid prior to cementing. In some examples, the fluid may be a plurality of different types of fluids mixed together and pumped and/or pumped separately in sequence.

The bobbin may be normally locked. For example, the bobbin may be prevented from rotating so that the optical cable is not released into the flow of cement. At 506, the optical cable is released by unlocking the bobbin.

In one example, the data processing system may signal the bobbin to freely spin which results in the optical cable being released. In another example, the plug may signal the float collar to allow the bobbin to freely spin which results in the optical cable being released. In yet another example, the float collar itself may allow the bobbin to freely spin which results in the optical cable being released. Additionally, the float collar may be arranged to allow fluid flow through the float collar via the arrangement of the check valve.

Viscous drag of the fluid on the optical cable may cause the bobbin to unspool and transport a leading end of the optical cable down the casing and into the annulus. At 508, one or more signals may be received from the one or more sensors associated with the optical cable. The one or more sensors associated with the optical cable may be used to monitor this pumping of cement. One or more of the float collar, plug, and/or data processing system may receive the one or more signals.

The fluid may flow in a manner such that the fluid first flows into the annulus, filling it, and then filling the casing downhole of the float collar. At 510, a determination is made that the annulus is filled with the fluid such as cement. The filling of the annulus may be indicated by a change in various conditions in the annulus and/or casing such as one or more of a pH, electrical conductivity, temperature, pressure, dielectric response, specific ion concentration measured by the one or more sensors and as indicated by the signals as fluid such as drilling fluid in the well is replaced with the fluid such as cement. For example, the change in the one or more signals may indicate that the annulus is filled with the fluid such as cement because the cement has reached the sensor in the annulus. As another example, the change in the one or more signals may indicate that the annulus is filled with the fluid such as cement because the cement has reached the sensor in the casing after filling the annulus. As yet another example, the fluid such as cement may be doped (e.g., with one or more chemicals) to improve detectability of the fluid by the one or more sensors. In this regard, the one or more signals from the one or more sensors may indicate that the annulus is filled with the fluid such as cement.

In one example, the flow collar may make this determination based on the one or more signals. In another example, the data processing system may make this determination based on the one or more signals.

At 512, flow of the fluid such as cement is stopped based on the determination. In one example, the float collar may make the determination, and signal the data processing system to stop pumping. Further, the check valve on the float collar may be arranged to prevent the fluid such as cement in the wellbore from flowing into the casing and the cement in the annulus and shoe from flowing back into the wellbore. In another example, the data processing system may make the determination and then stop pumping the fluid such as cement downhole.

Figure 6:
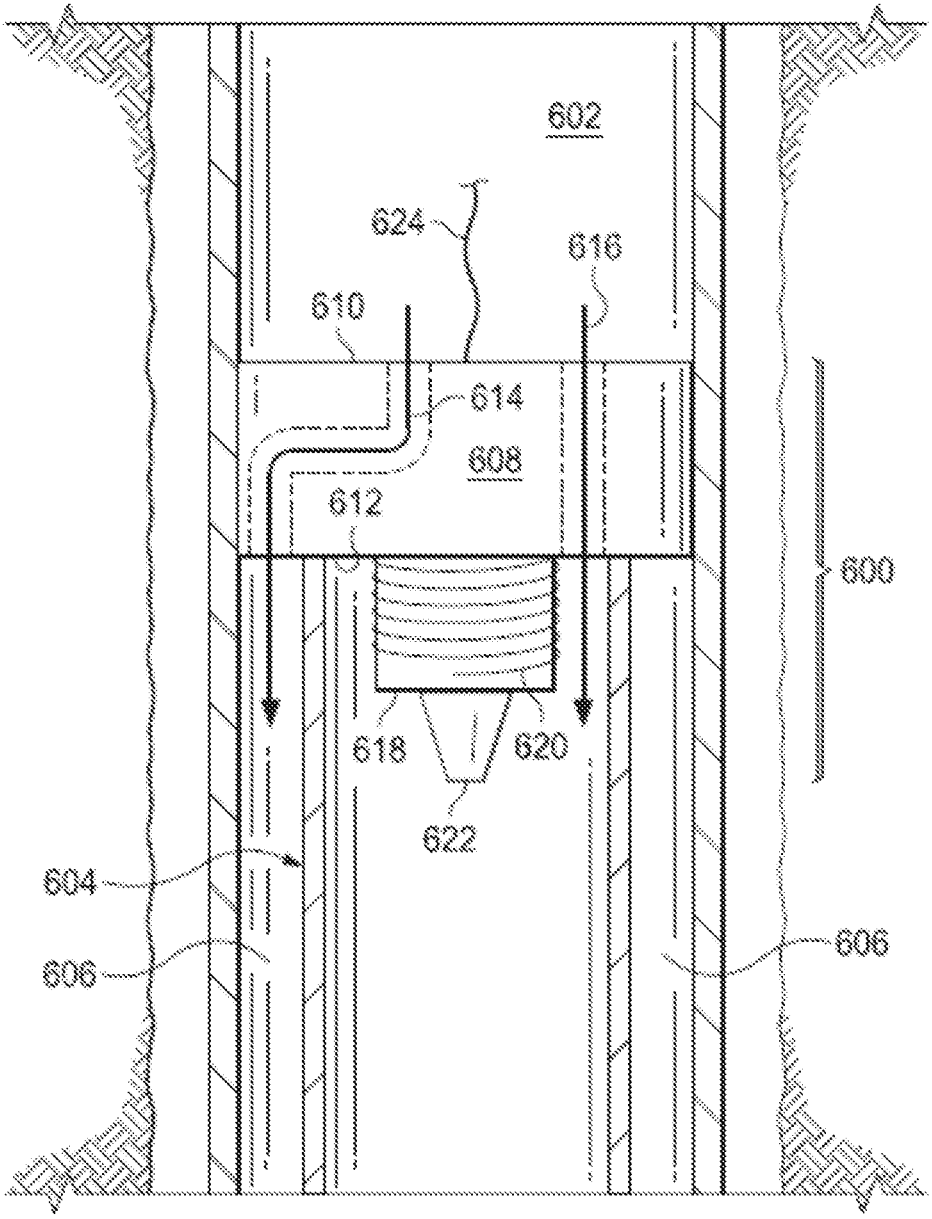
FIG. 6 is a diagram of the flow assembly in the form of a cross-over tool in the example well system.

FIG. 6 is a diagram of the flow assembly which takes the form of a cross-over tool 600 for performing the sensing. The cross-over tool 600 may be arranged in a wellbore 602 above a casing 604. The cross-over tool 600 may also be used to monitor cementing of the annulus 606. Unlike the float collar, the cross-over tool 600 may enable flow of fluid such as cement pumped within the wellbore 602 to flow as between the annulus 606 and/or casing 604.

A body 608 of the cross-over tool 600 may have a top surface 610 and a bottom surface 612. The top surface 610 may have a port for flowing fluid 614 in the wellbore 602 to the annulus 606. For example, fluid 614 from the wellbore 602 at the top surface 610 of the body 608 may enter the port on the top surface 610 and exit into the annulus 606. Further, the port may have a check valve (not shown). The check valve may allow the fluid to flow from the wellbore 602 to the annulus 606 but prevent fluid from flowing from the annulus 606 into the wellbore 602. Additionally, the top surface 610 and bottom surface 612 may have a port for flowing fluid 616 in the wellbore 602 at the top surface 610 to the casing 604 at the bottom surface 612. For example, fluid 616 from the wellbore 602 at the top surface 610 of the body 608 may enter the port and exit at the bottom surface 612 into the casing 604 downhole. Further, the port may have a check valve (not shown). The check valve may allow the fluid 616 to flow from the wellbore 602 at the top surface 610 to the casing 604 but prevent fluid from flowing from the casing 604 at the bottom surface 612 to the wellbore 602. In some cases, the body 608 may have a single port with multiple controllable valves to allow fluid to flow between the wellbore 602 and casing 604 or from the wellbore 602 to the annulus 606.

The cross-over tool 600 may have a bobbin 618 with optical cable 620. The bobbin 618 may take the form of the bobbin described with respect to the generalized flow assembly and float collar above. Additionally, an end of the optical cable 620 may have a drag member. The drag member may take the form of a dart 622 attached to an end of the optical cable in the bobbin 618. Signals as described below may be communicated from the dart 622 to the body 608 of the cross-over tool 600 via optical cable 620. In some cases, the signals may be communicated from the cross-over tool 600 to surface via telemetry 624. For example, the telemetry 624 may take the form of an optical or electrical connection.

Additionally, the cross-over tool 600 may have telemetry from the bottom surface 612 of the cross-over tool 600 to the top surface 610 of the cross-over tool 600 to communicate signals from the optical cable 620 which is located at the bottom surface 612 of the cross-over tool 600 to the top surface 610 of the cross-over tool 600 and to the data processing system. For example, the telemetry may take the form of close-range proximity acoustics or radio frequency communication device. The telemetry may take other forms as well.

Figure 7A:
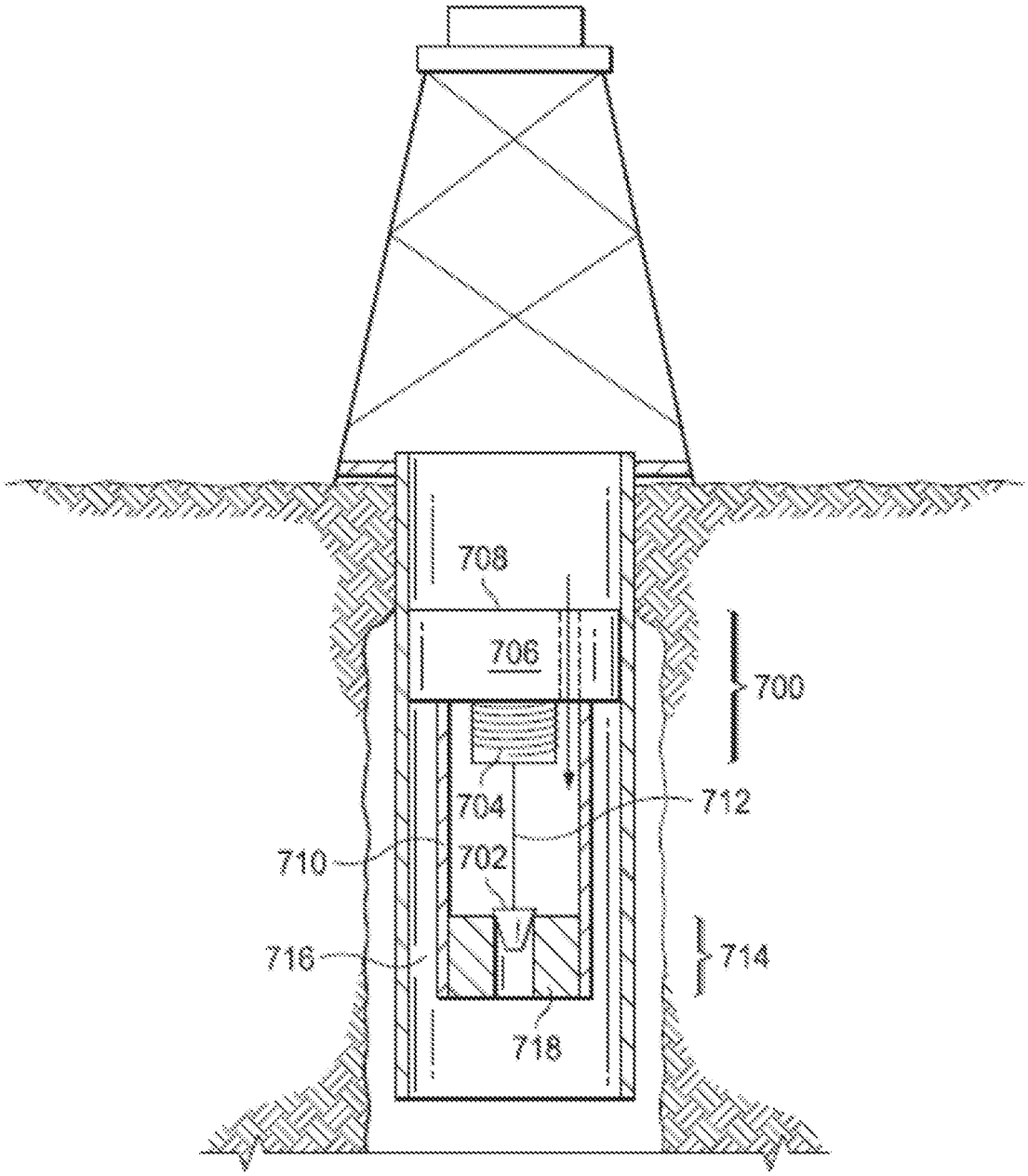
FIGS. 7A-B illustrates operation of the cross-over tool in the example well system.
Figure 7B:
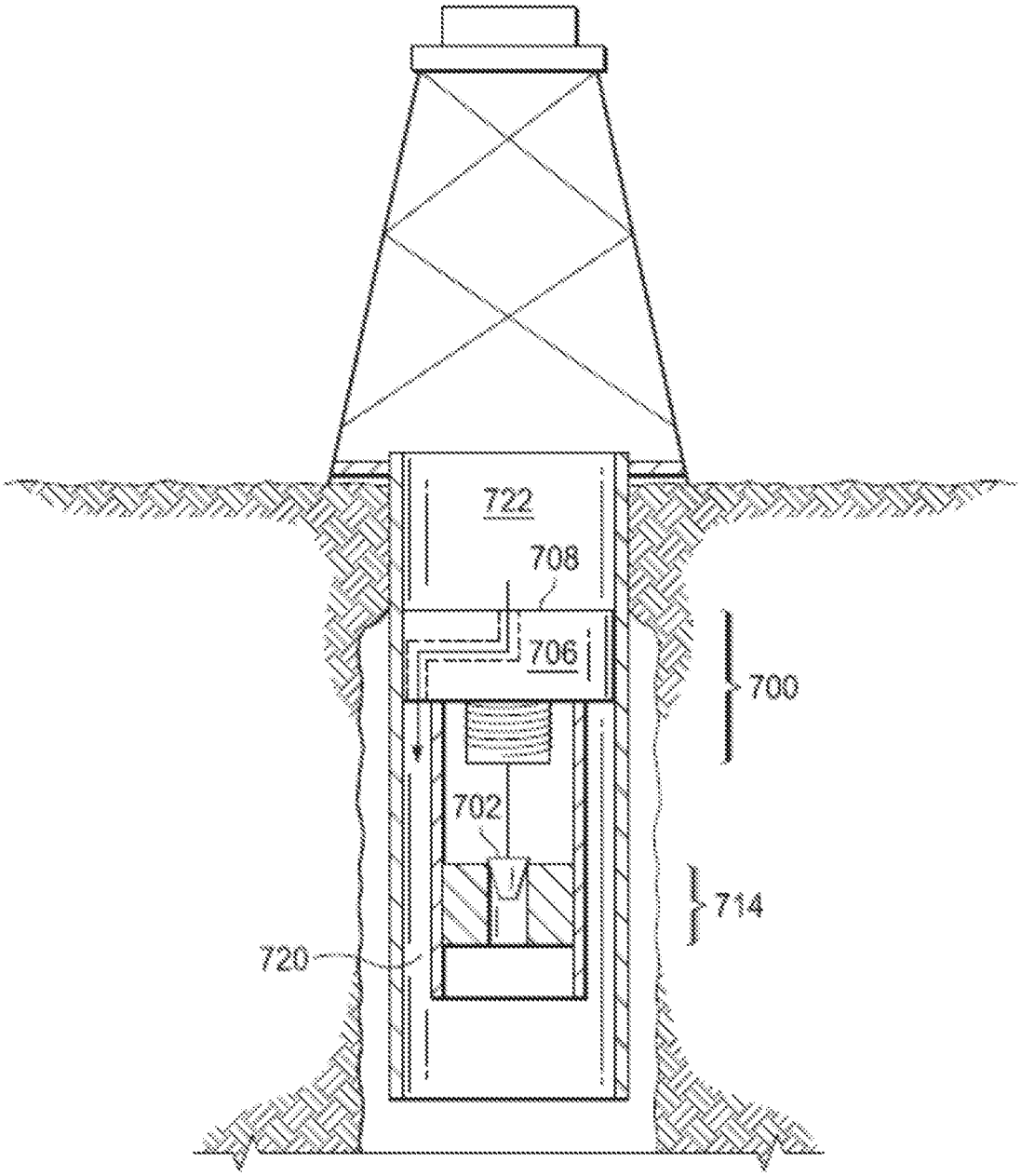

FIGS. 7A-7B illustrate an example operation of the cross-over tool 700. The figures are ordered in a time sequence such that operations associated with FIG. 7A occur before that of FIG. 7B.

FIG. 7A illustrates the cross-over tool 700 releasing the dart 702. The port and valves on the body 706 may be arranged to allow fluid at the top surface 708 of the cross-over tool 700 to enter into the port at the top surface 708 of the body 706 and exit into the casing 710. The fluid may take various forms such as drilling fluid. Further, the bobbin 704 may be normally locked to prevent the bobbin 704 from freely spinning. In response to the arrangement of the ports and valves, the cross-over tool 700 may now allow the bobbin 704 to freely spin. The fluid flow from the top surface 708 into the casing 710 may engage with the dart 702 and pull the dart 702 further downhole resulting in the optical cable 712 being unwound from the bobbin 704. The dart 702 may engage with float equipment 714. In some examples, the dart 702 may have one or more barbs which allows the dart to physically attach to the float equipment 714. The float equipment 714 may have been placed in the casing 710 at a precise location where conditions downhole are to be sensed. It is also possible to the install the float equipment 714 at any other desired location between the cross-over tool 700 and shoe 716. Further, the float equipment 714 may allow the dart 702 to remain in position regardless of direction of the fluid flow. In some examples, the float equipment 714 may have pressure discs 718 which burst when the dart engages with the float equipment 714. The burst pressure disks may allow the fluid to flow past the float equipment 714 even though the dart 702 is engaged with the float equipment 714.

FIG. 7B illustrates fluid flow after the dart 702 engages with the float equipment 714. The cross-over tool 700 may arrange its ports and valves so that fluid that enters the port at the top surface 708 of the body 706 of the cross-over tool 700 exits into the annulus 720 instead of exiting into the casing 710 downhole. Then, fluid may be pumped into the wellbore 722.

In some cases, the fluid may be cementing fluid for cementing the annulus. A light source may inject light into a fixed end of the optical cable 712. The fixed end may be opposite to the end which is pulled further downhole by the fluid flow. The light source may take the form of a broadband, continuous wave or pulsed laser or tunable laser located either at the surface or downhole. The dart 702 and/or float equipment 714 may be used to monitor the cementing process.

Figure 8:
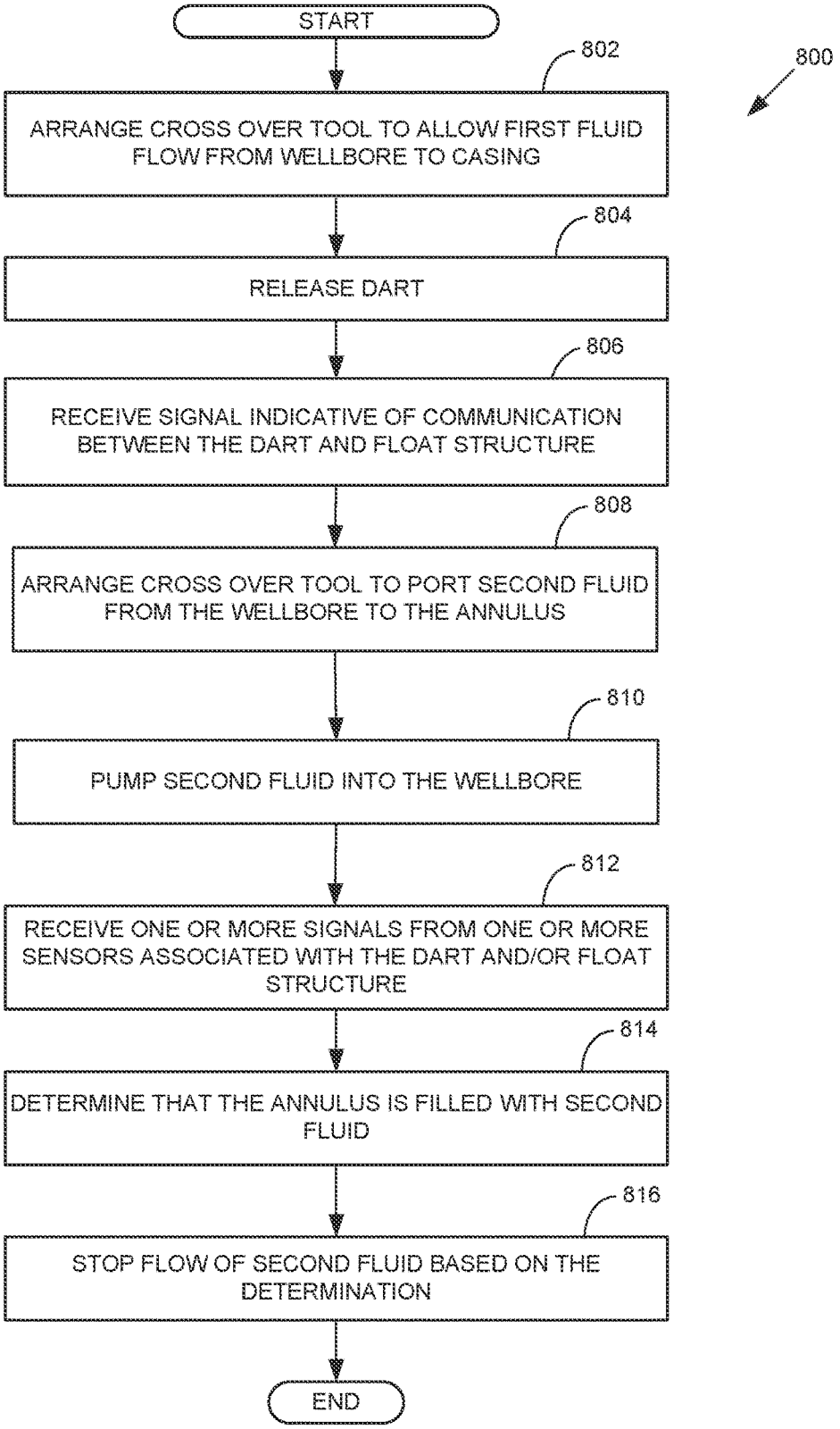
FIG. 8 is a flow chart of operations associated with a process using the cross-over tool.

FIG. 8 is a flow chart of operations associated with a process using the cross-over tool. The cross-over tool may be used to monitor pumping of cement from the wellbore into the annulus and/or casing to seal the annulus.

At 802, the cross-over tool may be arranged to allow fluid to flow from the wellbore to the casing. For example, the cross-over tool may receive a signal from the data processing system to allow the fluid flow. In some examples, the fluid may be a plurality of different types of fluids mixed together and pumped and/or pumped separately in sequence. In some examples, the fluid may be or include a spacer such as to aid in removal of drilling fluid. The spacer is prepared with specific fluid characteristics, such as viscosity and density, that are engineered to displace drilling fluid prior to cementing. The cross-over tool may allow the fluid to flow from the wellbore to the casing in other ways as well.

The bobbin may be locked from spinning so that the dart and optical cable cannot be released into the flow of fluid. At 804, the cross-over tool may release the dart. Viscous drag of the fluid on the dart and optical cable may cause the bobbin to unspool and transport and/or pull a leading end of the optical cable and dart down the casing. In one example, the cross-over tool may release the dart in response to the cross-over tool arranging to allow fluid flow from the wellbore to the casing. In another example, the cross-over tool may receive a signal from the data processing system to release the dart. The fluid flow may carry the dart to the float structure.

At 806, a signal is received indicative that communication between the dart and float structure is established. For example, the communication may be established in a manner similar to how the plug and float collar establish communication.

In some examples, the dart may not engage with a float structure. Instead, the dart may have barbs and/or protrusions which might engage with the casing to fix the location of the dart in the casing in presence of fluid flow. In this case, the signal that is received is indicative of the dart being fixed.

At 808, the cross-over tool may be arranged to port fluid from the wellbore into the annulus. In one example, the cross-over tool may be arranged to port fluid from the wellbore into the annulus in response to a signal. The cross-over tool may receive a signal from the data processing system to cause the cross-over tool to port fluid from the wellbore into the annulus. In another example, the cross-over tool may port fluid from the wellbore into the annulus in response to communication between the dart and float structure being established.

At 810, fluid is pumped into the wellbore. The crossover tool may port the fluid from the wellbore into the annulus. The fluid may be the same or different from the fluid flowed at 802 and/or include one or more fluids. In some examples, the fluid may be or include a spacer such as to aid in removal of drilling fluid. In some examples, the fluid may be a plurality of different types of fluids mixed together and pumped and/or pumped separately in sequence.

At 812, one or more signals may be received from the one or more sensors associated with the dart and/or float structure indicative of conditions in the casing at the location of the float structure. In one example, the dart may be equipped with various sensors (pH sensors, electrical conductivity sensors, temperature sensors, pressure sensors, dielectric response sensors, and specific ion concentration sensors are a few of the possibilities) and a battery for measuring a condition in the casing at the location of the float equipment and providing one or more signals indicative of the condition. In another example, the float equipment may be equipped with various sensors (pH, electrical conductivity, temperature, pressure, dielectric response, specific ion concentration are a few of the possibilities) and a battery for measuring a condition in the casing at the location of the float equipment and providing one or more signals indicative of the condition.

The fluid such as cement which is pumped may first flow to fill the annulus and then fill the space in the casing below the cross-over tool. At 814, a determination is made that the annulus is filled with the fluid such as cement. In one example, the cross-over tool may receive the one or more signals from the dart and/or floating structure via the optical cable and make the determination. In another example, the data processing system may receive the one or more signals via the optical cable and telemetry between the cross-over tool and data processing system and make the determination. The filling of the annulus may be indicated by a change in one or more of a pH, electrical conductivity, temperature, pressure, dielectric response, specific ion concentration at the location of the float structure measured by the one or more sensors and indicated by the signals as fluid such as drilling fluid in the well is replaced with the fluid such as cement at the location of the float structure and/or dart. For example, the one or more signals from the dart and/or float structure may indicate that the fluid such as cement has reached the dart which in turn indicates that the annulus is filled with the fluid such as cement. As yet another example, the fluid such as cement may be doped (e.g., with one or more chemicals) to improve detectability of the fluid such as cement by the one or more sensors.

At 816, flow of the fluid such as cement may be stopped based on the cement having reached the float structure. For example, if the cross-over tool makes the determination that the fluid such as cement reached the float structure, then the cross-over tool may send a signal to the data processing system which causes the data processing system to stop the pumping. Additionally, the cross-over tool itself may stop flow of the fluid such as cement from the wellbore into the annulus. The port may be arranged with a valve which can be closed to stop fluid flow through the port that fluidly connects the wellbore to the annulus. As another example, if the data processing system makes the determination that the fluid such as cement reached the float structure, then the data processing system may stop the pumping of the fluid such as cement and signal the cross-over tool to stop flow of the fluid such as cement from the wellbore into the annulus.

In some examples, the cross-over tool and float collar may operate in combination to control the cementing process. The dart may serve as a plug which when seated on the float collar causes the float collar to release its optical cable which may flow further downhole and/or into the annulus. In this regard, the dart may facilitate sensing at a location of float collar. In turn, the float collar may facilitate sensing at a location below the float collar and/or in the annulus. Fluid such as cement may be injected into the casing and the sensors may be used to monitor the cementing process of the annulus. For example, the dart may signal the data processing system when the cement reaches the dart. Additionally, the optical sensor may signal the data processing system when the fluid such as cement reaches the optical sensor. Other arrangements are also possible.

Example Computer

Figure 9:
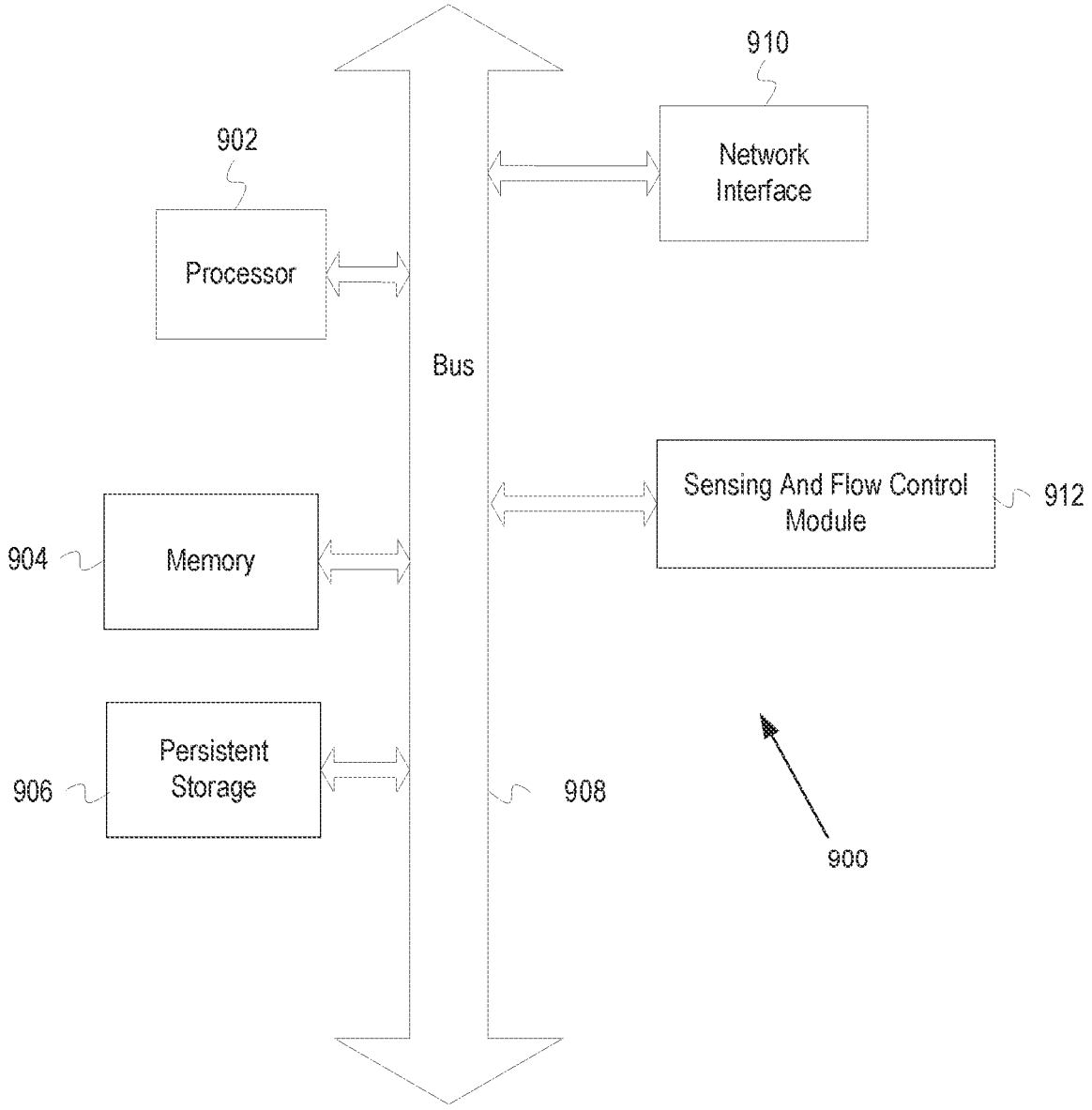
FIG. 9 is an example computer system associated with operation of the flow assembly.

FIG. 9 is a block diagram of a computer system 900 located at a surface of a formation or downhole. The data processing system, cross-over tool, and/or float collar may have instantiations of this computer system 900. In the case that the computer system 900 is downhole, the computer system 900 may be rugged, unobtrusive, can withstand the temperatures and pressures in situ at the wellbore.

The computer system 900 includes a processor 902 (possibly including multiple processors, multiple cores, multiple nodes, and/or implementing multi-threading, etc.). The computer device includes memory 904. The memory 904 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media.

The computer system also includes a persistent data storage 906. The persistent data storage 906 can be a hard disk drive, such as magnetic storage device. The computer device also includes a bus 908 (e.g., PCI, ISA, PCI-Express, HyperTransport® bus, InfiniBand® bus, NuBus, etc.) and a network interface 910 in communication with the downhole and/or surface sensors. The computer system 900 may have a sensing and flow control module 912 which senses and controls fluid flow into the annulus, such as to perform cementing of the annulus in accordance with the operations described above.

Any one of the previously described functionalities may be partially (or entirely) implemented in hardware and/or on the processor 902. For example, the functionality may be implemented with an application specific integrated circuit, in logic implemented in the processor 902, in a co-processor on a peripheral device or card, etc. Further, realizations may include fewer or additional components not illustrated in FIG. 9 (e.g., video cards, audio cards, additional network interfaces, peripheral devices, etc.). The processor 902 and the network interface 910 are coupled to the bus 908. Although illustrated as being coupled to the bus 908, the memory 904 may be coupled to the processor 902.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any non-transitory tangible medium that can contain, or store a program for use by or in connection with an instruction execution system, apparatus, or device. A machine readable storage medium is not a machine readable signal medium.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Additional embodiments can include varying combinations of features or elements from the example embodiments described above. For example, one embodiment may include elements from three of the example embodiments while another embodiment includes elements from five of the example embodiments described above.

Further, the embodiments described above are not limited to use of optical cable. An electrical cable which carries electrical signals may be used in lieu of an optical cable without loss of any functionality. In general, the optical cable, electrical cable, or another communication means may be considered a tether. Additionally, term fluid may encompass a single type of fluid, a mixture of different types of fluids and/or different fluids which are flowed separately in sequence. Other arrangements are also possible.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A method comprising: causing first fluid to flow from a wellbore through a flow assembly and into a casing inserted into the wellbore; releasing an optical cable of the flow assembly into the flow of the first fluid, wherein the optical cable is arranged on a bobbin affixed to a bottom surface of the flow assembly, and wherein the optical cable is positioned downhole from the flow assembly by the flow of the first fluid; receiving one or more signals via the optical cable; determining that an annulus between the casing and a wall of the wellbore is filled with a second fluid based on the one or more signals; and causing flow of the second fluid to be stopped based on the determination.

Embodiment 2: The method of Embodiment 1, wherein releasing the optical cable comprises causing the optical cable to be unwound from the bobbin as the flow of the first fluid pulls on an end of the optical cable.

Embodiment 3: The method of Embodiment 1 or Embodiment 2, wherein determining that the annulus between the casing and the wall is filled with the second fluid comprises detecting a change in one or more conditions in the casing based on the one or more signals.

Embodiment 4: The method of any of Embodiments 1-3, wherein the second fluid is cement, the method further comprising causing the second fluid to flow from the wellbore through the flow assembly and into the annulus based on a signal indicative of a dart attached to an end of the optical cable reaching a location in the casing.

Embodiment 5: The method of any of Embodiments 1-4, wherein the optical cable has one or more sensors to sense conditions in the annulus.

Embodiment 6: The method of any of Embodiments 1-5, wherein determining that the annulus between the casing and the wall of the wellbore is filled with the second fluid comprises determining that the casing is filled with cement.

Embodiment 7: The method of any of Embodiments 1-6, wherein releasing the optical cable of the flow assembly comprises causing a plug to contact the flow assembly which causes the bobbin to release the optical cable.

Embodiment 8: The method of any of Embodiments 1-7, wherein the first fluid and second fluid are the same.

Embodiment 9: An apparatus comprising: a body with a port for allowing fluid communication between a wellbore and a casing inserted into the wellbore; and a bobbin affixed to a bottom surface of the body, wherein optical cable is arranged on the bobbin.

Embodiment 10: The apparatus of Embodiment 9, wherein the port has a check valve for allowing fluid to flow from the wellbore to the casing and not allowing the fluid to flow from the casing to the wellbore.

Embodiment 11: The apparatus of Embodiment 9 or Embodiment 10, wherein the body further comprises another port for allowing fluid flow from the wellbore to an annulus between the casing and a wall of the wellbore.

Embodiment 12: The apparatus of any of Embodiments 9-11, wherein the optical cable comprises a drag member which is pulled by fluid flow to a float structure in the casing having one or more sensors which provide one or more signals indicative of whether the annulus is filled with cement.

Embodiment 13: The apparatus of any of Embodiments 9-12, wherein the optical cable comprises one or more sensors for sensing one or more conditions in the annulus.

Embodiment 14: The apparatus of any of Embodiments 9-13, wherein the body comprises a wet connect which when connected with a plug causes the optical cable to be released from the bobbin.

Embodiment 15: The apparatus of any of Embodiments 9-14, wherein the optical cable is released from the bobbin when the port is arranged to allow fluid flow between the wellbore and the casing inserted into the wellbore.

Embodiment 16: A system comprising: a data processing system; a flow assembly, wherein the flow assembly is positioned downhole in a wellbore of a geological formation, the flow assembly comprising a body with a port to allow fluid flow between a wellbore and a casing inserted into the wellbore; and a bobbin affixed to a bottom surface of the body, wherein an optical cable is arranged on the bobbin; and telemetry to communicate signals from the optical cable to the data processing system.

Embodiment 17: The system of Embodiment 16, wherein the body further comprises another port for allowing fluid flow from the wellbore to an annulus between the casing and a wall of the wellbore.

Embodiment 18: The system of Embodiment 16 or Embodiment 17, wherein the optical cable comprises a drag member which is pulled by fluid flow to engage with a float structure in the casing having one or more sensors which provide one or more signals to the optical cable indicative of whether the annulus is filled with cement.

Embodiment 19: The system of any of Embodiments 16-18, wherein the optical cable is positioned in an annulus between the casing and the wall of the wellbore based on the fluid flow.

Embodiment 20: The system of any of Embodiments 16-19, wherein the body comprises a wet connect which when engaged with a plug causes the bobbin to release the optical cable.

The invention claimed is:

1. A method comprising:

providing an optical fiber coiled about a bobbin at a first location in a wellbore in a subsurface formation, wherein a first end of the optical fiber is communicatively coupled to a data processing system;

pumping a first fluid through the wellbore during a cementing process, wherein a second end of the optical fiber is dragged through the wellbore via the pumped first fluid, wherein pumping the first fluid through the wellbore comprises pumping the first fluid into an annulus between a casing and a wall of the wellbore, and wherein the second end of the optical fiber is dragged into the annulus via the pumped first fluid; and monitoring, with the data processing system, a first wellbore condition based on a signal transmitted via the optical fiber at least while the optical fiber is dragged through the wellbore.

2. The method of claim 1, wherein pumping the first fluid through the wellbore comprises a viscous drag of the first fluid on the optical fiber causing the bobbin to unspool and transport the second end of the optical fiber down the casing and into the annulus.

3. The method of claim 2, further comprising pumping a second fluid through the wellbore, wherein pumping the first fluid comprises pumping the first fluid in a first direction and wherein pumping the second fluid comprises pumping the second fluid in a second direction.

4. The method of claim 3, wherein pumping the second fluid comprises a reverse cementing operation.

5. The method of claim 3, wherein pumping the second fluid comprises pumping the second fluid with use of a crossover tool.

6. The method of claim 1, wherein the second end of the optical fiber is coupled with a drag member and wherein the drag member is dragged through the wellbore via the pumped first fluid.

7. The method of claim 1, wherein providing an optical fiber further comprises: transmitting the signal from the first end of the optical fiber to the data processing system.

8. The method of claim 1, wherein pumping the first fluid through the wellbore comprises a forward cementing operation.

9. The method of claim 1, wherein the signal transmitted via the optical fiber comprises at least one of a first optical signal transmitted to a first sensor via the optical fiber and a second optical signal transmitted from the first sensor via the optical fiber.

10. The method of claim 1, wherein monitoring the first wellbore condition based on the signal further comprises:

obtaining an electric signal for transmission;

converting the electric signal to an optical signal; and transmitting the optical signal via the optical fiber; and wherein monitoring the first wellbore condition is based on the optical signal.

11. The method of claim 1, wherein monitoring the first wellbore condition further comprises:

determining that a change is indicated in the first wellbore condition; and stopping a flow of the first fluid through the wellbore based on the determination that the change is indicated.

12. An apparatus comprising:

an optical fiber, wherein the optical fiber is coiled about a bobbin at a first location in a wellbore in a subsurface formation, wherein a first end of the optical fiber is communicatively coupled with a data processing system, wherein a second end of the optical fiber is a lead end of the optical fiber, and wherein the optical fiber comprises one or more sensors;

a body positioned within the wellbore, the body comprising one or more ports configured to control a flow of a pumped first fluid within the wellbore, wherein controlling the flow of the pumped first fluid includes controlling the flow of the pumped first fluid into an annulus between a casing and a wall of the wellbore, and wherein the lead end of the optical fiber and at least one of the one or more sensors are configured to be dragged into the annulus via the flow of the pumped first fluid as part of a cementing process;

and the data processing system comprising, a processor; and a machine-readable medium having program code executable by the processor to cause the apparatus to, receive a first signal from the one or more sensors via the optical fiber while the optical fiber is being dragged through the wellbore by the pumped first fluid during the cementing process; and monitor a first wellbore condition based on the first signal.

13. The apparatus of claim 12, wherein program code executable by the processor is further configured to cause the apparatus to receive one or more second signals from the one or more sensors, and to monitor the first wellbore condition based on the first signal and the one or more second signals.

14. The apparatus of claim 12, wherein program code executable by the processor is further configured to cause the apparatus to monitor the first wellbore condition to monitor at least one of a forward cementing operation, a reverse cementing operation, a crossover operation, and a cement level.

15. The apparatus of claim 12, wherein the one or more sensors include at least one of a pressure sensor, a temperature sensor, a strain sensor, a bending sensor, a chemical sensor, a spectrographic sensor, a fiber Bragg grating, a dielectric response sensor, a pH sensor, an electrical conductivity sensor, an ion concentration sensor, a point sensor, and an optical sensor.

16. An apparatus comprising:

an optical fiber, wherein the optical fiber is coiled about a bobbin at a first location in a wellbore in a subsurface formation, wherein a first end of the optical fiber is communicatively coupled with a data processing system, and wherein a second end of the optical fiber is attached to a drag member;

a first sensor, wherein the optical fiber comprises the first sensor; and a data processing system comprising, a processor; and a machine-readable medium having program code executable by the processor to cause the apparatus to, receive a first signal from the first sensor via the optical fiber while the optical fiber is being dragged through the wellbore by a first fluid during a cementing process; and monitor a first wellbore condition based on the first signal, wherein the first end of the optical fiber is attached to a wet connect, and wherein the data processing system is communicatively coupled to the optical fiber via at least one of an optical connection and an electrical connection via the wet connect.

17. The apparatus of claim 12, further comprising:

a plug configured to be advanced through the wellbore and brought into contact with a top surface of the body, the plug configured to remove a dispersed mud or a mud sheath from the casing as the plug is advanced through the wellbore.

18. The apparatus of claim 17, wherein the body comprises a wet connector and the plug comprises a corresponding connector such that when the plug is brought into contact with the top surface of the body, a communication link is provided between the optical fiber and the data processing system through the wet connector and the corresponding connector.

19. The apparatus of claim 16, wherein the program code executable by the processor further comprises program code to, determine if a change is indicated in the first wellbore condition; and based on the determination that a change is indicated, at least one of stop a fluid flow and transmit a transmission signal via the optical fiber.

* * * * *